US007018693B1

(12) United States Patent
Heal et al.

(10) Patent No.: US 7,018,693 B1
(45) **Date of Patent: *Mar. 28, 2006**

(54) TABLE PAD COUPLING SYSTEM

(76) Inventors: Gary W. Heal, 4320 E 160 S., LaGrange, IN (US) 46761; Christopher P. Krauser, 3618 Rose Acres, Toledo, OH (US) 43615

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 12 days.

(21) Appl. No.: 11/077,482

(22) Filed: Mar. 10, 2005

Related U.S. Application Data

(63) Continuation of application No. 10/682,065, filed on Oct. 9, 2003, now Pat. No. 6,919,116.

(51) Int. Cl.
*B32B 3/10* (2006.01)

(52) U.S. Cl. ..... 428/54; 428/58; 428/192; 428/900; 248/346.01

(58) Field of Classification Search ..... 428/54, 428/55, 56, 58, 192, 900; 248/346.01
See application file for complete search history.

(56) References Cited

U.S. PATENT DOCUMENTS

| | | | | |
|---|---|---|---|---|
| 3,714,906 | A | 2/1973 | Finestone | 108/64 |
| 3,827,019 | A | 7/1974 | Serbu | 335/285 |
| 3,924,212 | A | 12/1975 | Brown | 335/303 |
| 4,517,232 | A | 5/1985 | Krauser | 428/57 |
| 5,476,701 | A | 12/1995 | Berger | 428/81 |
| D373,043 | S | 8/1996 | Zumbo et al. | D6/613 |
| 5,782,512 | A | 7/1998 | Cargnoni | 292/251.5 |
| 6,165,577 | A | 12/2000 | Berger | 428/58 |

FOREIGN PATENT DOCUMENTS

| | | |
|---|---|---|
| DE | 36 10 232 | 10/1987 |

*Primary Examiner*—Alexander S. Thomas

(57) ABSTRACT

A table pad coupling system including a first table pad and a second table pad. The first table pad having a plurality of peripheral surfaces including a first peripheral surface and a second peripheral surface, the first peripheral surface opposite the second peripheral surface. The first table pad additionally including a plurality of magnets positioned within the first table pad, the plurality of magnets including a first magnet associated with the first peripheral surface and a second magnet associated with the second peripheral surface, the first and second magnets having a surface of a same magnetic polarity, the surface of the first magnet and the surface of the second magnet outwardly oriented proximate the respective first and second peripheral surfaces. The second table pad having a plurality of peripheral surfaces including a first peripheral surface and a second peripheral surface, the first peripheral surface opposite the second peripheral surface, the first peripheral surface of the first table pad disposed adjacent the first peripheral surface of the second table pad.

10 Claims, 4 Drawing Sheets

| | CONFIGURATION NUMBER | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| A | N | F | S | N | S | F | N | S | N | S | F | F |
| B | S | N | F | F | N | S | S | N | F | F | N | S |
| C | F | S | N | S | F | N | N | S | N | S | F | F |

N=NORTH POLE
S=SOUTH POLE
F=FERROUS MATERIAL

TABLE PAD COUPLING SYSTEM

This application is a continuation of application Ser. No. 10/682,065, filed Oct. 9, 2003 now U.S. Pat. No. 6,919,116.

BACKGROUND OF THE INVENTION

1. Field of the Invention

The present invention relates to a table pad, and, more particularly, to a method and a system for assembling table pads on a tabletop.

2. Description of the Related Art

Table pads for the protection of tabletops are known in the art and are available from many sources. Table pads are manufactured to standard sizes, as well as custom sizes, primarily for the protection of wooden tabletops. Table pads normally have a cushioned or soft bottom surface for contact with the tabletop and a harder, more resilient often water resistant outer upper surface to resist heat and moisture damage that may occur from spills and the setting of hot dishes thereon.

Table pads are often manufactured to be folded or collapsed into smaller, more easily handled pieces. Additionally, table pads are often manufactured in sections, which are then linked together.

Referring now to FIG. 1 there is shown a prior art method that is detailed in U.S. Pat. No. 6,165,577, in which table pad assembly 10 includes a table pad 12 and a substantially similar table pad 14. Table pads 12 and 14 each have along one side an embedded iron piece designated by the letter I and along an opposite side a magnet is embedded therein designated by the letter M. Table pad 12 and table pad 14 are oriented such that magnet M of table pad 12 is proximate to iron I in table pad 14, thereby causing a magnetic attraction between magnet M and iron I along respective edges of table pads 12 and 14, thus causing table pads 12 and 14 to be coupled and to remain coupled during use. As can be understood, the sequence of the placement of additional table pads similar to table pad 12 or 14 in a series requires the alignment of each successive table pad such that a side with the iron embedded therein is located proximate to the side with a magnet located therein to achieve the coupling between the table pads 12 and 14.

A problem with the prior art method is that if table pads 12 and 14 are positioned on a tabletop such that the two iron pieces are proximate each other, no coupling occurs. Additionally, if the tabletop pads 12 and 14 are oriented such that magnets M of table pad 12 is proximate to magnet M of table pad 14 then a shifting may occur depending upon the pole orientation of magnets M in respective table pads 12 and 14. Even more of a problem exists if magnets M of table pads 12 and 14 have the same outwardly facing magnetic polarity, in which case table pads 12 and 14 would repel each other, thus defeating the purpose of positioning pads 12 and 14 next to each other.

What is needed in the art is a device and method that is independent of the orientation of a table pad.

SUMMARY OF THE INVENTION

The present invention provides a system and method to couple table pads together regardless of a surface orientation of the table pads.

The invention comprises, in one form thereof, a table pad coupling system including a first table pad and a second table pad. The first table pad having a plurality of peripheral surfaces including a first peripheral surface and a second peripheral surface, the first peripheral surface opposite the second peripheral surface. The first table pad additionally including a plurality of magnets positioned within the first table pad, the plurality of magnets including a first magnet associated with the first peripheral surface and a second magnet associated with the second peripheral surface, the first and second magnets having a surface of a same magnetic polarity, the surface of the first magnet and the surface of the second magnet outwardly oriented proximate the respective first and second peripheral surfaces. The second table pad having a plurality of peripheral surfaces including a first peripheral surface and a second peripheral surface, the first peripheral surface opposite the second peripheral surface, the first peripheral surface of the first table pad disposed adjacent the first peripheral surface of the second table pad.

An advantage of the present invention is that an otherwise symmetric table pad can be oriented in different manners and still provide magnetic coupling between table pads.

Another advantage of the present invention is that one table pad is provided having a magnetic orientation that is opposite to an adjacent table pad thereby increasing the magnetic coupling of two magnets located in adjacent table pads.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplification are not to be construed as limiting the scope of the invention in any manner.

DETAILED DESCRIPTION OF THE INVENTION

Figure 2:
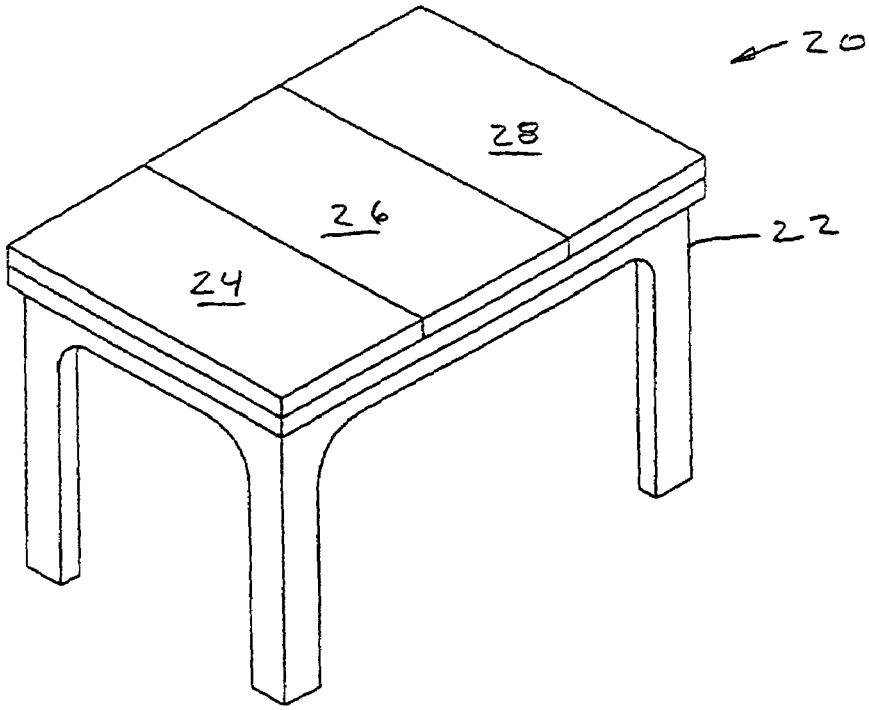
FIG. 2 is a perspective view of an embodiment of a table pad of the present invention.

Referring now to the drawings, and, more particularly to FIG. 2, there is shown a table pad assembly 20 of the present invention, including table pads 24, 26 and 28 positioned upon table 22. Although, as shown in FIG. 2, table pads 24, 26 and 28 are substantially similar in shape and size, it is understood that table pads 24, 26 and 28 may vary in shape and relative size. The contacting edges between pad 24 and 26 and between 26 and 28 are shown as substantially straight lines. While this is often the case, it is not to be construed that only straight interfaces have been contemplated by the present invention.

Figure 3:
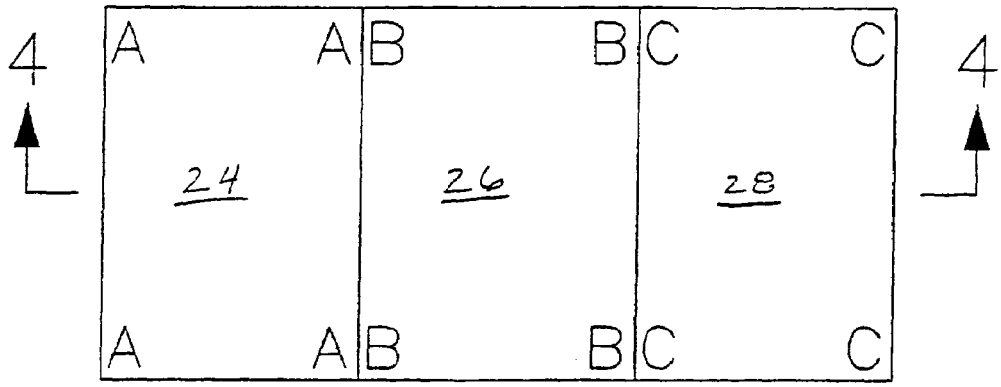
FIG. 3 is a schematized top view of three table pads configured in accordance with the present invention of FIG. 2.
Figure 4:
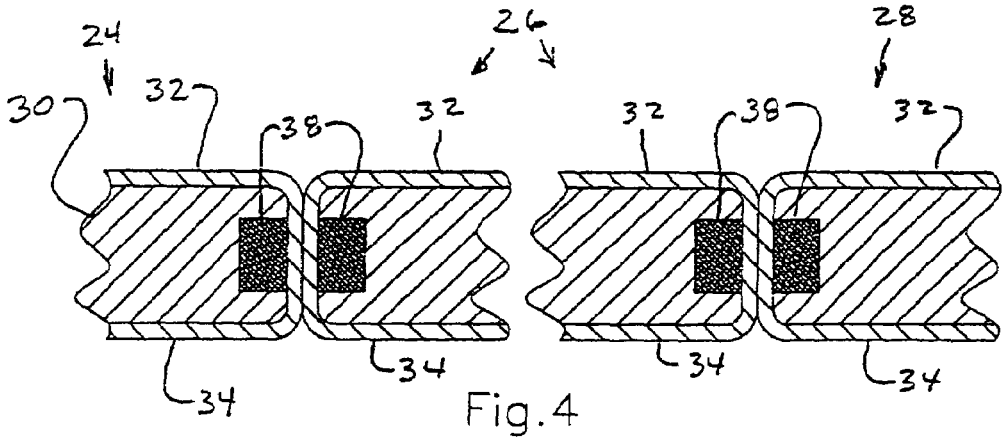
FIG. 4 is a schematized cross sectional view taken along section line 4—4 of the table pad of FIGS. 2 and 3.
Figures 5, 6:
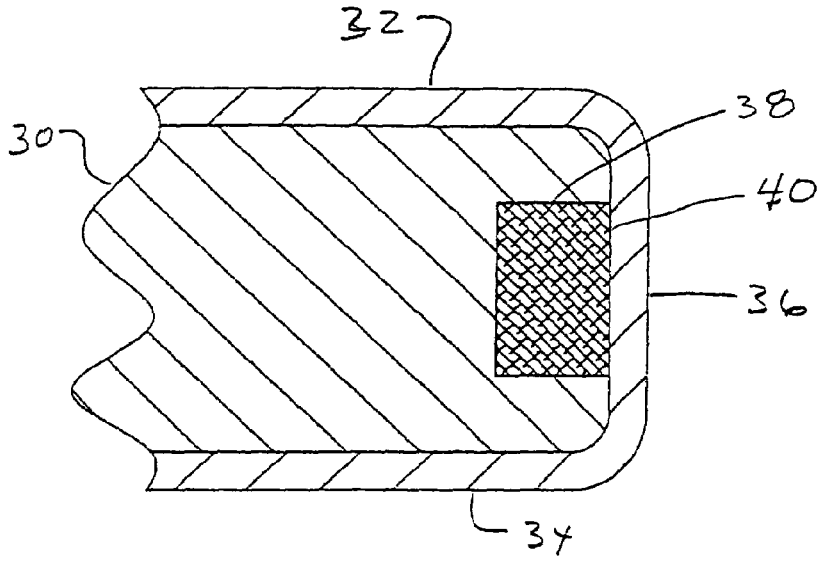
FIG. 5 is a magnified view of one part of a cross sectional view of the table pad of FIGS. 2, 3 and 4.
FIG. 6 is a table that illustrates a number of configurations of the table pads of the present invention, with characters A, B and C of FIG. 3 being assigned an N, S or F characteristic as defined in FIG. 6.

Now, additionally referring to FIGS. 3–6, there is illustrated a configuration system for the table pads of the present invention. It should be noted that each table pad 24, 26 and 28 each have letters, illustrated in FIG. 3, which correspond to the type of coupler 38 that is located within each table pad. Table pads 24, 26 and 28 include a core 30, an upper surface 32, a lower surface 34, a peripheral surface 36, a coupler 38 and an outwardly facing portion 40 of coupler 38. Peripheral surface 36 of table pads 24 and 26 are in surface contact with each other. Coupler 38 of table pad 24, which is schematically illustrated as letter A in FIG. 3, is configured to be compatible with coupler 38 of table pad 26. The possible configurations of table pads 24, 26 and 28 are illustrated in FIG. 6, wherein coupler 38 of material A may, for example, represent a magnet having an outward surface 40 of north pole orientation (N), an outward facing surface 40 of a south pole orientation (S) or a ferrous material (F). Additionally, it is noted that the general rule for the orientation of table pads 24, 26 and 28 are such that any adjacent pad must be of a different configuration than itself. For example, a north pole N outward facing surface 40 is coupled with either a table pad having a south pole S outward facing surface 40 or ferrous material F and is never coupled with a table pad having another north pole N outward facing surface 40.

Upper surface 30 of table pads 24, 26 and 28 are of a heat and water resistant material that is additionally resistive to warping or changes with temperature or environment. Top surface 32 is connected to core 30. Core 30 additionally has embedded therein couplers 38. Core 30 may be made of an insulating-type material that is rigid, yet light enough for easy handling. Lower surface 34 is made of felt or another soft material that will not scratch or harm a finished wooden tabletop. Peripheral surface 36 may be made of either the material utilized in top surface 32 or bottom surface 34 or some other material. Peripheral surface 36 is magnetically inert, thereby allowing the magnetic attraction between couplers 38. Table pads 24, 26 and 28 each have at least one coupler along each of two opposite peripheral edges with preferably at least two couplers 38 along each of two opposite peripheral edges of each respective table pad.

Advantageously, configuration numbers 7 and 8, of FIG. 6, illustrate a series of table pads having magnets in each of the adjacent table pads. This configuration results in maximum attraction between table pads. It is also recognized that a series of table pads are not limited to three as shown in FIG. 3, but may be two table pads or a continuing series that simply is configured to ensure that each adjacent pad is not of the same configuration type as itself.

Figure 7:
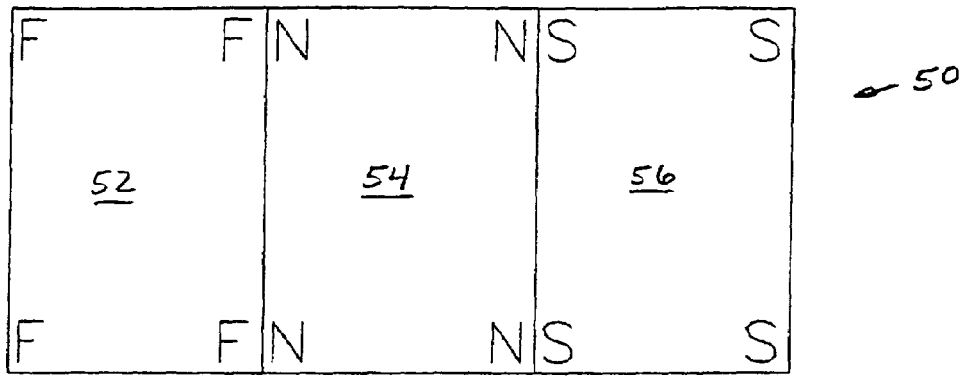
FIG. 7 is a schematized top view of three table pads configured in accordance with one of the possible configurations of the present invention detailed in FIG. 6.

Now, additionally referring to FIG. 7, there is shown a specific embodiment of the present invention, which corresponds with configuration number 2 of FIG. 6. Table pad configuration 50 includes table pads 52, 54 and 56. Table pad 52 has at least two ferrous members F with at least one arranged proximate to each of two opposite peripheral edges. Table pad 54 has at least two magnets each with a north pole N directed outwardly along one of two opposite peripheral edges. Table pad 56 has at least two magnets each with a south pole S directed outwardly along one of two opposite peripheral edges. This arrangement or any combination of the three pads, with each table pad oriented with either of the two opposite edges adjacent another table pad results in a coupled table pad system.

Figure 8:
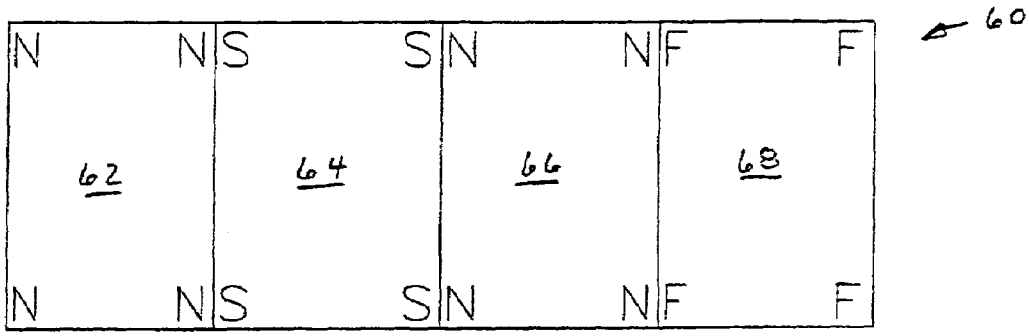
FIG. 8 is a schematized top view of four table pads of the present invention arranged in a manner consistent with the table pad system of FIGS. 3 and 6.

Now, additionally referring to FIG. 8, there is shown a specific embodiment of the present invention, with the three leftmost pads corresponding with configuration number 7 of FIG. 6, and the three rightmost pads corresponding with configuration number 5 of FIG. 6. Table pad configuration 60 includes table pads 62, 64, 66 and 68. Table pad 62 has at least two magnets each with a north pole N directed outwardly along one of two opposite peripheral edges. Table pad 64 has at least two magnets each with a south pole S directed outwardly along one of two opposite peripheral edges. Table pad 66 is substantially identical with table pad 62. Table pad 68 has at least two ferrous members F with at least one arranged proximate to each of two opposite peripheral edges. This arrangement or any combination of table pads, which adhere to the combinations of three table pads as defined in FIG. 6, results in a coupled table pad system.

Figure 9:
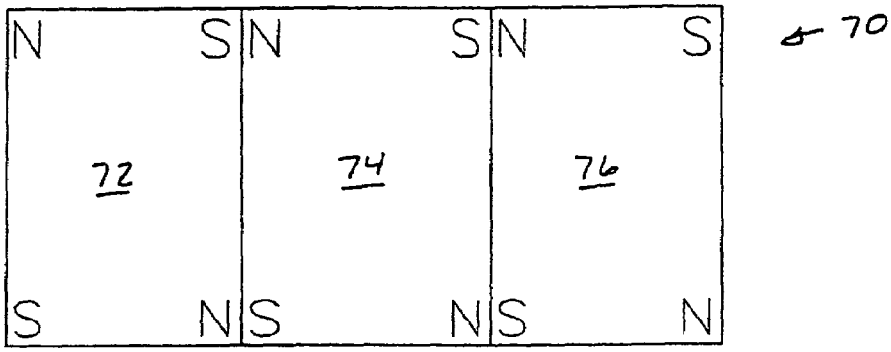
FIG. 9 is a schematized top view of three table pads configured in accordance with another embodiment of the present invention.

Now, additionally referring to FIG. 9, there is shown table pad coupling system 70, which is another embodiment of the present invention. System 70 includes table pads 72, 74 and 76, each of which has at least two magnets each with a north pole N directed outwardly along one of two respective opposite peripheral edges and at least two magnets each with a south pole S directed outwardly along one of two respective opposite peripheral edges. Table pads 72, 74 and 76 are substantially similar and are interchangeable. The magnets are arranged along the peripheral edges of table pads 72, 74 and 76 such that magnets N and S of adjacent table pads will align when the respective peripheral edges are aligned, thereby coupling the respective table pads together. This arrangement allows any of table pads 72, 74 and 76 to be rotated 180° or exchanged with each other and they will still be aligned in a configuration in which adjacent table pads are attracted to each other. This embodiment allows one magnetic configuration in all table pads and allows magnetic coupling with another identical table pad. Any number of adjacent table pads of this configuration may be utilized in a sequential manner even with 180° rotational change in any of the table pads.

Figure 1:
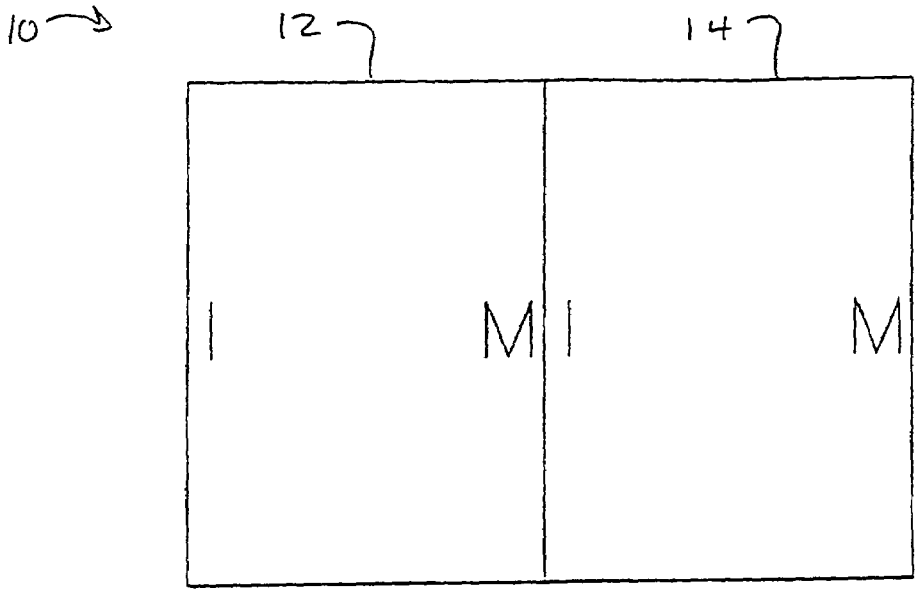
Prior Art Fig. 1
FIG. 1 is a schematic view of prior art illustrating the positioning of an iron piece along one peripheral edge of a table pad and a magnet along another peripheral edge of a table pad.

A prior art method of joining table pads, as illustrated in FIG. 1, discloses a table pad having a magnetically active structure M on one edge of the table pad and a magnetically receptive structure I on an opposite edge of the table pad. An advantage of the present invention over this prior art is that magnetically active structures are positioned on each of the opposite edges resulting in a doubling of the attraction over the prior art method. The attraction is doubled, with the same strength magnets, since the magnetic fields are arranged so that the magnets in one table pad attract the magnets in an adjacent table pad.

Advantageously, the attraction between couplers 38 is overcome when the table pads are removed without the need of any mechanical latching or unlatching device. It is also noted that in many applications some couplers 38 may be omitted in end sections of a series of table pads, since an end section will only couple with one adjacent section. This is particularly the situation when the end sections are shaped to correspond with a non-rectangular table. Such an end section will normally only have couplers 38 along a peripheral edge that is expected to be coupled with another table pad section.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A table pad coupling system, comprising:

a plurality of table pads, including:

a first table pad having:

a plurality of peripheral surfaces including a first peripheral surface and a second peripheral surface, said first peripheral surface opposite said second peripheral surface; and at least one magnet positioned within said first table pad, said at least one magnet including a first magnet associated with said first peripheral surface, said first magnet having a surface of a first magnetic polarity, said surface of said first magnet being outwardly oriented proximate said first peripheral surface; and a second table pad having:

a plurality of peripheral surfaces including a first peripheral surface and a second peripheral surface, said first peripheral surface opposite said second peripheral surface, said first peripheral surface of said first table pad disposed adjacent said first peripheral surface of said second table pad; and at least one magnet positioned within said second table pad, said at least one magnet including a second magnet associated with said first peripheral surface of said second table pad, said second magnet having a surface of a second polarity, said of said second magnet being outwardly oriented, said second magnet being magnetically coupled with said first magnet.

2. A table pad coupling system, comprising:

a plurality of table pads, including:

a first table pad having:

a plurality of peripheral surfaces including a first peripheral surface and a second peripheral surface, said first peripheral surface opposite said second peripheral surface; and a plurality of magnets positioned within said first table pad, said plurality of magnets including a first magnet associated with said first peripheral surface and a second magnet associated with said second peripheral surface, said first and second magnets having a surface of a same magnetic polarity, said surface of said first magnet and said surface of said second magnet outwardly oriented proximate said respective first and second peripheral surfaces; and a second table pad having:

a plurality of peripheral surfaces including a first peripheral surface and a second peripheral surface, said first peripheral surface opposite said second peripheral surface, said first peripheral surface of said first table pad disposed adjacent said first peripheral surface of said second table pad, a plurality of ferrous members positioned within said second table pad, said plurality of ferrous members including a first ferrous member and a second ferrous member, said first ferrous member proximate said first peripheral surface of said second table pad and said second ferrous member proximate said second peripheral sure of said second table pad, said second table pad not containing any magnets.

3. The system of claim 2, wherein said plurality of table pads further includes a third table pad substantially similar to said first table pad, said first peripheral surface of said third table pad disposed proximate said second peripheral surface of said second table pad.

4. The system of claim 2, wherein said plurality of table pads further includes a third table pad substantially similar to said second table pad, said first peripheral surface of said third table pad disposed proximate to said second peripheral surface of said first table pad.

5. The system of claim 2, wherein said plurality of table pads include a first plurality of table pads substantially similar to said first table pad and a second plurality of table pads substantially similar to said second table pad, said plurality of table pads being arranged on a table top such that each table pad from said first plurality of table pads is only adjacent to table pads from said second plurality of table pads.

6. A method of arranging a series of table pads, comprising the steps of:

positioning a first table pad on a table, said first table pad including:

a plurality of peripheral surfaces including a first peripheral surface and a second peripheral surface, said first peripheral surface opposite said second peripheral surface; and at least one magnet positioned within said first table pad, said at least one magnet including a first magnet associated with said first peripheral surface, said first magnet having a surface of a first magnetic polarity, said surface of said first magnet being outwardly oriented proximate said first peripheral surface; and arranging a second table pad adjacent to said first table pad, said second table pad including:

a plurality of peripheral surfaces having a first peripheral surface and a second peripheral surface, said first peripheral surface opposite said second peripheral surface, said first peripheral surface of said first table pad disposed adjacent said first peripheral surface of said second table pad; and at least one magnet positioned within said second table pad, said at least one magnet including a second magnet associated with said first peripheral surface of said second table pad, said second magnet having a surface of a second polarity, said surface of said second magnet being outwardly oriented, said second magnet being magnetically coupled with said first magnet.

7. A method of arranging a series of table pads, comprising the steps of:

positioning a first table pad on a table, said first table pad including:

a plurality of peripheral surface including a first peripheral surface and a second peripheral surface, said first peripheral surface opposite said second peripheral surface; and a plurality of magnets positioned within said first table pad, said plurality of magnets including a first magnet associated with said first peripheral surface and a second magnet associated with said second peripheral surface, said first and second magnets having a surface of a same magnetic polarity, said surface of said first magnet and said surface of said second magnet outwardly oriented proximate said respective first and second peripheral surfaces; and arranging a second table pad adjacent to said first table pad, said second table pad including:

a plurality of peripheral surfaces having a first peripheral surface and a second peripheral surface, said first peripheral surface opposite said second peripheral surface, said first peripheral surface of said first table pad disposed adjacent said first peripheral surface of said second table pad; and a plurality of ferrous members positioned within said second table pad, said plurality of ferrous members including a first ferrous member and a second ferrous member, said first ferrous member proximate said first peripheral surface of said second table pad and said second ferrous member proximate said second peripheral surface of said second table pad, said second table pad not including any magnets.

8. The method of claim 7, further comprising the step of arranging a third table pad, said third table pad substantially similar to said first table pad, said first peripheral surface of said third table pad disposed proximate said second peripheral surface of said second table pad.

9. The method of claim 7, further comprising the step of arranging a third table pad, said third table pad substantially similar to said second table pad, said first peripheral surface of said third table pad disposed proximate to said second peripheral surface of said first table pad.

10. The method of claim 7, further comprising the step of sequentially arranging a plurality of table pads including a first plurality of table pads substantially similar to said first table pad and a second plurality of table pads substantially similar to said second table pad, said plurality of table pads being arranged on a table top such that each table pad from said first plurality of table pads is only adjacent to table pads from said second plurality of table pads.

* * * * *

UNITED STATES PATENT AND TRADEMARK OFFICE

CERTIFICATE OF CORRECTION

PATENT NO. : 7,018,693 B1
APPLICATION NO. : 11/077482
DATED : March 28, 2006
INVENTOR(S) : Heal et al.

It is certified that error appears in the above-identified patent and that said Letters Patent is hereby corrected as shown below:

TITLE PAGE

Column 2, after "Primary Examiner-Alexander S. Thomas", on the next line please insert --Item [74] Attorney, Agent, or Firm - Taylor & Aust, P.C.--.

COLUMN 5

At line 40, after "said" and before "of" on line 41, insert --surface--.

Signed and Sealed this

Second Day of January, 2007

JON W. DUDAS
*Director of the United States Patent and Trademark Office*